US009994940B2

(12) United States Patent
Oura et al.

(10) Patent No.: US 9,994,940 B2
(45) Date of Patent: Jun. 12, 2018

(54) HIGH CARBON STEEL WIRE ROD HAVING EXCELLENT DRAWABILITY

(75) Inventors: Hiroshi Oura, Kobe (JP); Nao Yoshihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 616 days.

(21) Appl. No.: 13/881,750

(22) PCT Filed: Oct. 24, 2011

(86) PCT No.: PCT/JP2011/074417
§ 371 (c)(1),
(2), (4) Date: Apr. 26, 2013

(87) PCT Pub. No.: WO2012/057070
PCT Pub. Date: May 3, 2012

(65) Prior Publication Data

US 2013/0216423 A1 Aug. 22, 2013

(30) Foreign Application Priority Data

Oct. 29, 2010 (JP) ..... 2010-244311

(51) Int. Cl.
*C22C 38/02* (2006.01)
*C22C 38/14* (2006.01)
(Continued)

(52) U.S. Cl.
CPC ..... *C22C 38/14* (2013.01); *C21D 8/065* (2013.01); *C21D 9/0081* (2013.01); *C21D 9/525* (2013.01); *C22C 38/001* (2013.01); *C22C 38/002* (2013.01); *C22C 38/02* (2013.01); *C22C 38/04* (2013.01); *C22C 38/06* (2013.01);
(Continued)

(58) Field of Classification Search
CPC ..... C22C 38/02–38/06
USPC ..... 148/330, 333; 420/99, 100, 104, 120, 420/121
See application file for complete search history.

(56) References Cited

U.S. PATENT DOCUMENTS 4,423,253 A 12/1983 Leston
6,322,641 B1 11/2001 Makii et al.
(Continued)

FOREIGN PATENT DOCUMENTS

CA 2 500 108 A1 4/2004
CA 2 617 381 A1 12/2007
(Continued)

OTHER PUBLICATIONS

Extended European Search Report dated Feb. 27, 2014 in Patent Application No. 11836204.5.
(Continued)

*Primary Examiner* — Brian Walck
(74) *Attorney, Agent, or Firm* — Oblon, McClelland, Maier & Neustadt, L.L.P.

(57) ABSTRACT

This high carbon steel wire rod, which has excellent drawability in addition to high strength required for a wire rod, contains 0.6-1.5% of C, 0.1-1.5% of Si, 0.1-1.5% of Mn, 0.02% or less of P (excluding 0%), 0.02% or less of S (excluding 0%), 0.03-0.12% of Ti, 0.001-0.01% of B and 0.001-0.005% of N, with solid-solved B being 0.0002% or more, solid-solved N being 0.0010% or less, and the balance being made up of iron and inevitable impurities. In addition, the content of Ti solid-solved in the steel is 0.002% by mass or more, and the content of Ti that formed carbides is 0.020% by mass or more.

19 Claims, 1 Drawing Sheet

(51) Int. Cl.

| | |
|---|---|
| ***C21D 8/06*** | (2006.01) |
| ***C22C 38/00*** | (2006.01) |
| ***C22C 38/04*** | (2006.01) |
| ***C22C 38/24*** | (2006.01) |
| ***C22C 38/28*** | (2006.01) |
| ***C22C 38/32*** | (2006.01) |
| ***C22C 38/06*** | (2006.01) |
| ***C22C 38/12*** | (2006.01) |
| ***C21D 9/00*** | (2006.01) |
| ***C21D 9/52*** | (2006.01) |

(52) U.S. Cl.
CPC ..... *C22C 38/12* (2013.01); *C22C 38/24* (2013.01); *C22C 38/28* (2013.01); *C22C 38/32* (2013.01); *C21D 2211/004* (2013.01)

(56) References Cited

U.S. PATENT DOCUMENTS

| | | | |
|---|---|---|---|
| 6,406,565 | B1 | 6/2002 | Hashimura et al. |
| 2005/0217766 | A1 | 10/2005 | Fukuzumi et al. |
| 2007/0095439 | A1 | 5/2007 | Yoshihara |
| 2007/0277913 | A1 | 12/2007 | Kochi et al. |
| 2009/0007998 | A1 | 1/2009 | Kochi et al. |
| 2009/0025832 | A1 | 1/2009 | Yoshihara |
| 2009/0229711 | A1 | 9/2009 | Yamasaki et al. |
| 2010/0034691 | A1 | 2/2010 | Yoshihara |
| 2010/0239844 | A1 | 9/2010 | Manabe et al. |
| 2011/0041962 | A1 | 2/2011 | Fukuzumi et al. |
| 2012/0205013 | A1 | 8/2012 | Fukuzumi et al. |
| 2013/0022491 | A1 | 1/2013 | Oura et al. |

FOREIGN PATENT DOCUMENTS

| | | | |
|---|---|---|---|
| CN | 101208446 | A | 6/2008 |
| EP | 0 943 697 | A1 | 9/1999 |
| EP | 1 577 411 | A1 | 9/2005 |
| EP | 1 783 239 | A1 | 5/2007 |
| EP | 1 865 079 | A1 | 12/2007 |
| EP | 2 096 184 | A1 | 9/2009 |
| JP | 8 295930 | | 11/1996 |
| JP | 2000-178685 | A | 6/2000 |
| JP | 2001-288539 | A | 10/2001 |
| JP | 2005-232549 | A | 9/2005 |
| JP | 2007 231347 | | 9/2007 |
| JP | 2007 327084 | | 12/2007 |
| JP | 2008 133539 | | 6/2008 |
| JP | 2009 24245 | | 2/2009 |
| JP | 2009-280836 | A | 12/2009 |
| JP | 4423253 | | 3/2010 |
| JP | 2010 229468 | | 10/2010 |
| KR | 10-2004-0107786 | A | 12/2004 |
| KR | 10-2007-0047691 | | 5/2007 |
| KR | 10-2009-0010926 | | 1/2009 |
| WO | 2008 093466 | | 8/2008 |

OTHER PUBLICATIONS

International Search Report dated Jan. 24, 2012 in PCT/JP11/74417 Filed Oct. 24, 2011.
U.S. Appl. No. 13/638,722, filed Oct. 1, 2012, Oura, et al.

HIGH CARBON STEEL WIRE ROD HAVING EXCELLENT DRAWABILITY

TECHNICAL FIELD

The present invention relates to high carbon steel wire rods which are drawn into wires and then used typically in prestressed concrete wires, suspension bridge cables, and various wire ropes widely used as reinforcing materials for prestressed concrete structures typically of buildings and bridges. More specifically, the present invention relates to high carbon steel wire rods having better drawability.

BACKGROUND ART

High carbon steel wire rods used typically in prestressed concrete wires, suspension bridge cables, and various wire ropes should have high strengths and satisfactory ductility after wire drawing and, in addition, should have good drawability from the viewpoint of productivity. To meet these requirements, a variety of high quality high carbon steel wire rods have been developed.

Typically, Patent Literature (PTL) 1 proposes a technique of improving resistance to hydrogen embrittlement of a wire rod. This technique specifies the contents of Ti in the forms of a nitride, a sulfide, and a carbide in a spring steel wire rod having a low C content (0.35% to 0.65%) and a high Si content (1.5% to 2.5%) and thereby effectively helps the spring steel wire rod to have finer grains and to trap hydrogen, thus improving the resistance to hydrogen embrittlement.

This technique, however, is intended to be applied to spring steels, and the spring steel wire rod before wire drawing may probably have a structure including ferrite and pearlite. The spring steel wire rod therefore has a low tensile strength and not-so-good drawability as compared to high carbon steel wire rods.

Independently, PTL 2 proposes a technique of improving drawability of a wire rod by specifying the area of intragranular transformed upper bainite present in a cross section of the wire rod and the growth size of such intragranular bainite. The bainitic structure, however, has a lower work hardenability than that of pearlite and fails to provide sufficient strengths after wire drawing.

CITATION LIST

Patent Literature

PTL 1: Japanese Patent No. 4423253

PTL 2: Japanese Unexamined Patent Application Publication (JP-A) No. H08-295930

SUMMARY OF INVENTION

Technical Problem

The present invention has been made to solve such problems in customary techniques, and an object thereof is to provide a high carbon steel wire rod which has high strengths as a wire rod and exhibits superior drawability.

Solution to Problem

The present invention has achieved the object and provides a high carbon steel wire rod including C in a content of 0.6% to 1.5%; Si in a content of 0.1% to 1.5%; Mn in a content of 0.1% to 1.5%; P in a content of more than 0% and less than or equal to 0.02%; S in a content of more than 0% and less than or equal to 0.02%; Ti in a content of 0.03% to 0.12%; B in a content of 0.001% to 0.01%; and N in a content of 0.001% to 0.005%, in mass percent, in which a solute boron content is 0.0002% or more; a solute nitrogen content is 0.0010% or less; the high carbon steel wire rod further comprises iron and inevitable impurities; and the high carbon steel wire rod satisfies conditions specified by following Expressions (1) and (2):

$$[\text{sol.Ti}]=[\text{Ti}]-[\text{Ti with N}]-[\text{Ti with C}]-[\text{Ti with S}]\geq 0.002 \quad (1),$$

$$[\text{Ti with C}]\geq 0.020 \quad (2),$$

where:

[sol.Ti] represents a content of solute titanium dissolved in the steel;

[Ti] represents a total Ti content;

[Ti with N] represents a content of Ti in the form of a nitride;

[Ti with C] represents a content of Ti in the form of a carbide; and

[Ti with S] represents a content of Ti in the form of a sulfide, in mass percent in the steel.

The high carbon steel wire rod of the present invention may further usefully contain other element or elements according to necessity, which are typified by (a) Al in a content of more than 0% and less than or equal to 0.1%; and (b) at least one selected from the group consisting of Cr in a content of more than 0% and less than or equal to 0.45% and V in a content of more than 0% and less than or equal to 0.5%. The high carbon steel wire rod, when containing any of these elements, may have better properties according to the type of the added element.

Advantageous Effects of Invention

The present invention can provide a high-strength high carbon steel wire rod exhibiting superior drawability by suitably controlling its chemical composition and ensuring contents of solute titanium and Ti in the form of a carbide at predetermined levels or higher. The high carbon steel wire rod is very useful as materials typically for prestressed concrete wires, suspension bridge cables, and various wire ropes.

DESCRIPTION OF EMBODIMENTS

Figure 1:
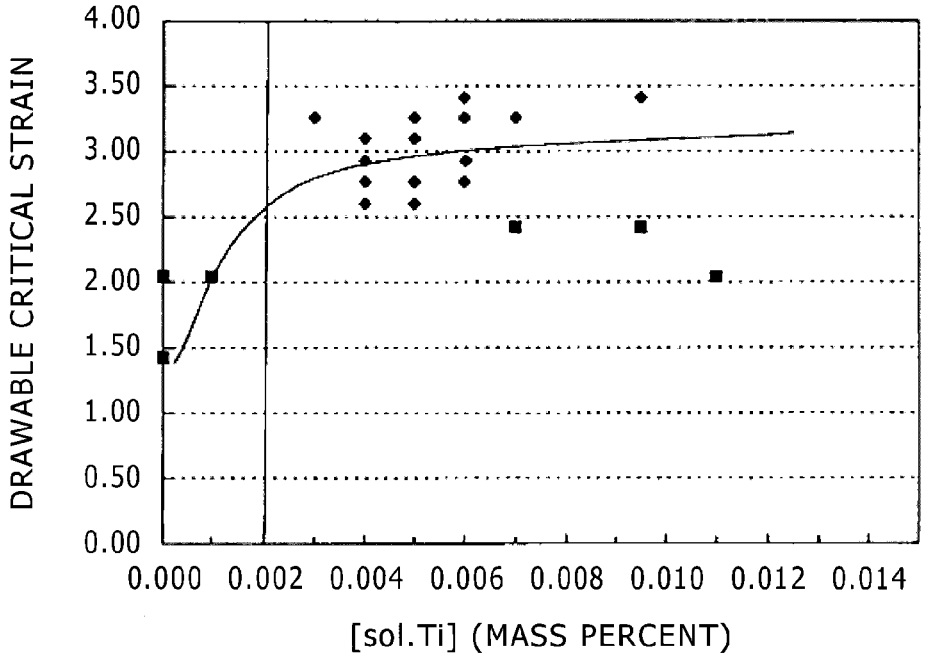
FIG. 1 is a graph illustrating how the drawable critical strain varies depending on the content of solute titanium [sol.Ti].

After various intensive investigations to improve drawability of high strength high carbon steel wire rods, the present inventors have found that a high carbon steel wire rod can have better drawability by adding a sufficient content of Ti to convert solute nitrogen into titanium nitride to thereby minimize solute nitrogen in the steel and by allowing the steel to contain solute boron at a predetermined level or higher; and that the high carbon steel wire rod can have further dramatically improved drawability when satisfying conditions specified by following Expressions (1) and (2).

The present invention has been made based on these findings. Expressions (1) and (2) are expressed as follows:

$$[\text{sol.Ti}]=[\text{Ti}]-[\text{Ti with N}]-[\text{Ti with C}]-[\text{Ti with S}]\geq 0.002 \quad (1),$$

$$[\text{Ti with C}]\geq 0.020 \quad (2),$$

where:

[sol.Ti] represents a content of solute titanium dissolved in the steel;

[Ti] represents a total Ti content;

[Ti with N] represents a content of Ti in the form of a nitride;

[Ti with C] represents a content of Ti in the form of a carbide; and

[Ti with S] represents a content of Ti in the form of a sulfide, in mass percent in the steel.

The configuration improves the drawability probably for the following reasons. Specifically, solute titanium, when formed by dissolving Ti in ferrite, may impede diffusion of solute carbon, which will be diffused by the action of drawing strain, thereby impede dislocation locking of solute carbon, and suppress aging embrittlement caused by dislocation locking of solute carbon due to the drawing strain. In addition, by allowing Ti in the form of a carbide to be present at a predetermined level or more (namely, typically by precipitating titanium carbide (TiC)), solute carbon in ferrite may be reduced probably slightly, and this may suppress aging embrittlement caused by dislocation locking of solute carbon due to the drawing strain.

Expression (1) provides a content of solute titanium [sol.Ti], which is determined based on a relation between a total titanium content and a content of Ti in the form of various titanium compounds (e.g., TiN, TiC and TiS). Solute titanium, when formed by dissolving Ti in ferrite, impedes diffusion of solute carbon, which will be diffused by the action of drawing strain, thereby impedes dislocation locking of solute carbon, and suppresses aging embrittlement caused by dislocation locking of solute carbon due to the drawing strain (see FIG. 1 as mentioned below). The critical strain in wire drawing is significantly improved by satisfying the condition specified by Expression (1) (namely, by allowing the content of solute titanium [sol.Ti] to be 0.002% or more). The content of solute titanium [sol.Ti] is preferably 0.003% or more, and more preferably 0.004% or more.

Expression (2) provides a content of Ti in the form of a carbide (content typically of precipitated TiC). By precipitating titanium-based carbides at a certain level or higher, solute carbon in ferrite decreases slightly, and this may suppress aging embrittlement caused by dislocation locking of solute carbon due to the drawing strain. The critical strain in wire drawing significantly increases by satisfying the condition specified by Expression (2) (namely, by allowing Ti in the form of a carbide (titanium-based carbide) to be present in a content of 0.020% or more). The content of Ti in the form of a titanium-based carbide [Ti with C] is preferably 0.021% or more, and more preferably 0.022% or more.

The high carbon steel wire rod of the present invention should have a chemical composition suitably controlled. Reasons to specify the ranges of contents of respective elements (including the content of solute boron and the content of solute nitrogen) in the chemical composition are as follows.

[C in a Content of 0.6% to 1.5%]

Carbon (C) element is economical and effective for strengthening. With an increasing carbon content, the magnitude of work hardening upon wire drawing and the strength after wire drawing increase. A wire rod having a carbon content of less than 0.6% may be difficult to include a pearlite structure that is excellent in work hardenability upon wire drawing. To avoid this, the carbon content may be 0.6% or more and is preferably 0.65% or more, and more preferably 0.7% or more. In contrast, a wire rod having an excessively high carbon content, may suffer from net-like pro-eutectoid cementite generated at austenite grain boundaries and become susceptible to a break upon wire drawing, and, after final wire drawing, may have significantly inferior toughness/ductility. To avoid these, the carbon content may be 1.5% or less and is preferably 1.4% or less, and more preferably 1.3% or less.

[Si in a Content of 0.1% to 1.5%]

Silicon (Si) element is necessary for deoxidation of the steel and is dissolved in a ferrite phase in the pearlite structure to effectively contribute to higher strengths after patenting. A wire rod having a low Si content of less than 0.1% may not effectively undergo deoxidation and may suffer from insufficient improvements in strength. To avoid these, the Si content may be 0.1% in terms of its lower limit and is preferably 0.15% or more, and more preferably 0.2% or more. In contrast, a wire rod having an excessively high Si content may suffer from poor ductility of the ferrite phase in the pearlite structure and may suffer from poor ductility after wire drawing. To avoid these, the Si content may be up to 1.5% and is preferably 1.4% or less, and more preferably 1.3% or less.

[Mn in a Content of 0.1% to 1.5%]

Manganese (Mn) element is useful as a deoxidizer, as with Si; effectively contributes to higher strengths of the wire rod; and, in addition, fixes sulfur in the steel as manganese sulfide MnS to prevent hot embrittlement. To exhibit these effects, Mn may be present in a content of 0.1% or more, preferably 0.2% or more, and more preferably 0.3% or more. In contrast, manganese element is liable to segregate, and, if present in a content of more than 1.5%, may segregate in a core of the wire rod to form martensite and bainite in the segregated area to thereby adversely affect the drawability. To avoid these, the Mn content may be 1.5% or less and is preferably 1.4% or less, and more preferably 1.3% or less.

[P in a Content of More than 0% and Less than or Equal to 0.02%]

Phosphorus (P) element is an inevitable impurity and is preferably minimized. In particular, phosphorus causes solute strengthening of ferrite and thereby significantly causes deterioration of drawability. To avoid these, the phosphorus content herein may be 0.02% or less and is preferably 0.01% or less, and more preferably 0.005% or less.

[S in a Content of More than 0% and Less than or Equal to 0.02%]

Sulfur (5) element is an inevitable impurity and is preferably minimized. In particular, sulfur forms MnS-based inclusions and thereby adversely affects drawability. To avoid these, the sulfur content herein may be 0.02% or less and is preferably 0.01% or less, and more preferably 0.005% or less.

[Ti in a Content of 0.03% to 0.12%]

Titanium (Ti) element is effective as a deoxidizer, is present as solute titanium in ferrite to suppress the diffusion of solute carbon, and forms titanium carbides/nitrides (carbides, nitrides, and carbonitrides) to thereby effectively reduce solute carbon that causes embrittlement upon wire drawing. Such titanium carbides/nitrides are also effective for preventing austenite grains from being coarse. The element (Ti) therefore contributes to better drawability and also effectively contributes to higher ductility. To exhibit these effects, the Ti content may be 0.03% or more and is preferably 0.04% or more, and more preferably 0.05% or more. In contrast, a wire rod having an excessively high Ti content may suffer from generation of coarse titanium carbides/nitrides in austenite to thereby have insufficient drawability. To avoid these, the Ti content may be 0.12% or less and is preferably 0.11% or less, and more preferably 0.10% or less.

[B in a Content of 0.001% to 0.01% (where a Solute Boron Content is 0.0002% or More)]

Boron (B) element effectively suppresses ferrite precipitation. Specifically, boron element contributes to suppression of ferrite precipitation, and effectively suppresses longitudinal crack of a drawn wire. The solute boron content should be 0.0002% or more, because boron, when exhibiting the above effects, is present as solute boron. In addition, a wire rod having a boron content of less than 0.001% may be difficult to include solute boron at a certain level or more and may not sufficiently effectively contribute to suppression in longitudinal crack of the drawn wire. For these reasons, the boron content may be 0.001% or more and is preferably 0.0015% or more, and more preferably 0.0020% or more. In contrast, boron, if present in a content of more than 0.01%, may form $Fe_{23}(CB)_6$ and other compounds, and this may reduce the content of boron present as solute boron and reduce the effects of suppressing longitudinal crack of the drawn wire. To avoid these, the boron content may be 0.01% or less and is preferably 0.009% or less, and more preferably 0.008% or less.

[N in a Content of 0.001% to 0.005% (where a Solute Nitrogen Content is 0.0010% or Less)]

Nitrogen (N) element, when present as solute nitrogen, causes embrittlement during wire drawing and adversely affects the drawability. To avoid these, the solute nitrogen content should be reduced down to 0.0010% or less by allowing Ti to precipitate as titanium carbides/nitrides. A wire rod having an excessively high nitrogen content may suffer from insufficient fixation of nitrogen by the action of titanium and thereby suffer from increased solute nitrogen. To avoid this, the nitrogen content may be 0.005% or less in terms of its upper limit and is preferably 0.004% or less, and more preferably 0.003% or less. In contrast, a wire rod having a nitrogen content of less than 0.001% is not practical in terms of production cost. For this reason, the nitrogen content may be 0.001% or more in terms of its lower limit and is preferably 0.0015% or more, and more preferably 0.0020% or more.

The high carbon steel wire rod of the present invention includes basic elements as mentioned above and further includes iron and inevitable impurities (impurities other than phosphorus and sulfur). Specifically, the wire rod may further contain, as the inevitable impurities, elements which are brought into the steel typically from raw materials, construction materials, and manufacturing facilities. The high carbon steel wire rod of the present invention may further usefully contain other element or elements according to necessity, which are typified by (a) Al in a content of more than 0% and less than or equal to 0.1%; and (b) at least one selected from the group consisting of Cr in a content of more than 0% and less than or equal to 0.45% and V in a content of more than 0% and less than or equal to 0.5%. The high carbon steel wire rod, when containing any of these elements, may have better properties according to the type of the added element.

[Al in a Content of More than 0% and Less than or Equal to 0.1%]

Aluminum (Al) element is effective as a deoxidizer and forms aluminium nitride AlN to prevent austenite from having a larger grain size. However, Al, if present in an excessively high content, may exhibit saturated effects and adversely affect economical efficiency. To avoid these, the Al content is preferably 0.1% or less, more preferably 0.09% or less, and furthermore preferably 0.08% or less. To exhibit the effects, the Al content is preferably 0.005% or more, more preferably 0.010% or more, and furthermore preferably 0.015% or more.

[Cr in a Content of More than 0% and Less than or Equal to 0.45% and/or V in a Content of More than 0% and Less than or Equal to 0.5%]

Chromium (Cr) and vanadium (V) elements each effectively improve strengths, drawability, and other properties of the wire rod. Of these elements, Cr allows pearlite to have a finer lamellar spacing and improves strengths, drawability, and other properties of the wire rod. However, a wire rod having an excessively high Cr content may be susceptible to the formation of undissolved cementite, may suffer from the formation of supercooling structures such as martensite and bainite in a hot-rolled wire rod because of a longer transformation end time, and may have inferior mechanical descaling properties. To avoid these, the Cr content is preferably 0.45% or less, more preferably 0.40% or less, and furthermore preferably 0.35% or less. To exhibit the effects, the Cr content is preferably 0.01% or more, more preferably 0.03% or more, and furthermore preferably 0.05% or more.

Vanadium disperses as fine carbonitrides, thereby contributes to finer austenite grain size and nodule size, effectively narrows the pearlite lamellar spacing, and effectively contributes to higher strengths and better drawability. Vanadium also effectively reduces the break incidence, because such finer austenite grain size and nodule size contribute to prevention of microcracks, which are liable to form during wire drawing, and contribute to suppression of formed microcracks from extending. Vanadium also helps the wire rod to have better corrosion resistance. However, vanadium, if present in an excessively high content, may not only exhibit saturated effects of improving corrosion resistance, but also adversely affect toughness and ductility. To avoid these, the vanadium content is preferably 0.5% or less, more preferably 0.45% or less, and furthermore preferably 0.40% or less. To exhibit the effects, the vanadium content is preferably 0.01% or more, more preferably 0.015% or more, and furthermore preferably 0.02% or more.

To manufacture the high carbon steel wire rod of the present invention by controlling the content of titanium so as to satisfy the conditions specified by Expressions (1) and (2), the wire rod may be manufactured by casting a molten steel having a chemical composition within the above-specified range, and hot rolling the cast steel while controlling these processes as mentioned below.

When casting is performed through continuous casting, a cooling rate (solidifying rate) at temperatures from 1500° C. down to 1400° C. is effectively controlled to 0.8° C./second or less. Such slow cooling at temperatures from 1500° C. down to 1400° C. helps Ti to fix free nitrogen sufficiently. The cooling rate is preferably 0.6° C./second or less, and more preferably 0.5° C./second or less. However, cooling, if proceeds excessively slowly, may cause precipitates to be coarse. To avoid this, the cooling rate is preferably 0.05° C./second or more, more preferably 0.1° C./second or more, and furthermore preferably 0.2° C./second or more.

Heating of semi-finished products (e.g., billets) before hot rolling is effectively performed at a temperature (highest temperature of the semi-finished products) of 1200° C. or higher. Heating, when performed at such a sufficiently high temperature, may help titanium to fix free nitrogen sufficiently. The heating temperature is preferably 1210° C. or higher, and more preferably 1220° C. or higher. Heating, if performed at an excessively high temperature, may cause precipitates to be coarse. To avoid this, the heating temperature is preferably 1300° C. or lower, more preferably 1290° C. or lower, and furthermore preferably 1280° C. or lower.

The heated semi-finished products are generally descaled by spraying water before hot rolling. The spraying is effectively performed under intense conditions so as to start hot rolling from a start temperature (temperature immediately before rough rolling) of 950° C. or lower. Hot rolling, when starting from such a low start temperature, helps carbides of titanium to precipitate sufficiently. The hot rolling start temperature is preferably 945° C. or lower, and more preferably 940° C. or lower. Hot rolling performed at a start temperature within this range may prevent precipitates from being coarse. The hot rolling start temperature, however, is effectively set to 850° C. or higher. Hot rolling, when starting from a start temperature being not excessively low, helps titanium to fix free nitrogen sufficiently. The hot rolling heating temperature is preferably 855° C. or higher, and more preferably 860° C. or higher.

After hot rolling, cooling is preferably performed from a cooling start temperature (post-rolling cooling start temperature, such as Stelmor-controlled cooling temperature) of 800° C. or higher and 950° C. or lower to allow carbides of titanium to precipitate sufficiently. In addition, cooling from the cooling start temperature down to 700° C. is effectively performed at a cooling rate of 20° C./second or more (preferably 25° C./second or more, and more preferably 30° C./second or more) and 100° C./second or less (preferably 90° C./second or less, and more preferably 80° C./second or less). Cooling, when performed within this temperature range at a high rate, can ensure a necessary amount of solute titanium while allowing titanium carbides to precipitate in necessary amounts. Other manufacturing conditions than mentioned above may employ common conditions.

EXAMPLES

The present invention will be illustrated in further detail with reference to several experimental examples below. It should be noted, however, that these examples are never construed to limit the scope of the invention; and various modifications and changes may be made without departing from the scope and sprit of the invention and should be considered to be within the scope of the invention.

Each 80 tons of steels (Steels A to V) having chemical compositions given in Table 1 below were made by melting, continuously cast, and yielded slabs having a profile of 430 mm by 300 mm. In Table 1, elements indicated by "—" were not added. Cooling rates (solidifying rates) from 1500° C. down to 1400° C. upon continuous casting are given in Table 2 below.

The continuously cast slabs were bloomed into billets having a profile of 155 mm by 155 mm, the billets were subjected to hot rolling under conditions (pre-hot-rolling heating temperature, hot rolling start temperature, post-rolling cooling start temperature, and cooling rate from the cooling start temperature down to 700° C.) given in Table 2, and yielded high carbon steel wire rods having a diameter of 6.0 mm. Titanium contents (total contents of titanium), boron contents (total contents of boron) and nitrogen contents (total contents of nitrogen) indicated in Table 1 are values of prepared wire rods and are determined by the following measuring methods.

[Measuring Methods]

Total titanium content: Determined according to inductively coupled plasma (ICP) emission spectrometry (Japanese Industrial Standard (JIS) G 1258-1).

Total boron content: Determined according to the curcumin spectrophotometric method (JIS G 1227, Appendix 2)

Total nitrogen content: Determined according to the thermal conductiometric method after fusion in a current of inert gas (JIS G 1228, Appendix 4).

TABLE 1

| | Chemical composition* (in mass percent) | | | | | | | | | | |
|---|---|---|---|---|---|---|---|---|---|---|---|
| Steel | C | Si | Mn | P | S | Cr | Al | Ti | V | B | N |
| A | 0.72 | 0.26 | 0.70 | 0.008 | 0.007 | — | 0.031 | 0.039 | — | 0.0013 | 0.0020 |
| B | 0.71 | 0.41 | 0.42 | 0.006 | 0.015 | 0.41 | — | 0.064 | — | 0.0029 | 0.0024 |
| C | 0.71 | 0.21 | 0.66 | 0.013 | 0.015 | — | — | 0.107 | 0.05 | 0.0034 | 0.0033 |
| D | 0.73 | 0.29 | 0.57 | 0.013 | 0.011 | — | — | 0.068 | — | 0.0022 | 0.0023 |
| E | 0.82 | 0.68 | 0.53 | 0.014 | 0.006 | — | — | 0.071 | — | 0.0028 | 0.0037 |
| F | 0.82 | 0.31 | 0.51 | 0.007 | 0.003 | — | — | 0.077 | — | 0.0022 | 0.0022 |
| G | 0.81 | 0.24 | 0.40 | 0.007 | 0.015 | — | 0.014 | 0.08 | — | 0.0028 | 0.0026 |
| H | 0.80 | 0.25 | 0.55 | 0.010 | 0.006 | — | — | 0.047 | — | 0.0029 | 0.0027 |
| I | 0.82 | 0.22 | 0.82 | 0.014 | 0.008 | — | — | 0.048 | — | 0.0018 | 0.0029 |
| J | 0.92 | 0.31 | 0.44 | 0.008 | 0.009 | 0.31 | — | 0.077 | 0.11 | 0.0033 | 0.0030 |
| K | 0.93 | 1.20 | 0.66 | 0.012 | 0.007 | — | — | 0.046 | 0.22 | 0.0043 | 0.0041 |
| L | 0.91 | 0.26 | 0.49 | 0.009 | 0.009 | — | 0.028 | 0.079 | — | 0.0029 | 0.0022 |
| M | 0.94 | 0.22 | 0.63 | 0.007 | 0.015 | 0.22 | — | 0.076 | — | 0.0024 | 0.0020 |
| N | 0.97 | 0.30 | 0.49 | 0.013 | 0.010 | — | — | 0.067 | — | 0.0023 | 0.0029 |
| O | 1.03 | 0.22 | 0.51 | 0.014 | 0.009 | 0.22 | — | 0.056 | — | 0.0028 | 0.0021 |
| P | 1.06 | 0.21 | 0.67 | 0.014 | 0.006 | — | 0.071 | 0.072 | 0.05 | 0.0024 | 0.0026 |
| Q | 1.11 | 0.25 | 0.69 | 0.008 | 0.007 | — | — | 0.064 | | 0.0017 | 0.0033 |
| R | 1.15 | 0.22 | 0.65 | 0.009 | 0.006 | — | — | 0.083 | 0.09 | 0.0029 | 0.0029 |
| S | 1.23 | 0.30 | 0.51 | 0.0012 | 0.007 | 0.17 | — | 0.061 | — | 0.0026 | 0.0031 |
| T | 1.37 | 0.33 | 0.53 | 0.015 | 0.011 | — | — | 0.073 | — | 0.0023 | 0.0033 |
| U | 0.84 | 0.44 | 0.43 | 0.005 | 0.007 | — | — | 0.047 | — | 0.0018 | 0.0072 |
| V | 1.11 | 0.25 | 0.69 | 0.008 | 0.007 | — | — | 0.016 | 0.07 | 0.0017 | 0.0037 |

*Remainder: Iron and inevitable impurities other than P and S

TABLE 2

| Test number | Steel | Solidifying rate (° C./sec) | Pre-hot-rolling heating temperature (° C.) | Hot rolling start temperature (° C.) | Post-rolling cooling start temperature (° C.) | Cooling rate from cooling start temperature down to 700° C. (° C./sec) |
|---|---|---|---|---|---|---|
| 1 | A | 0.2 | 1254 | 924 | 913 | 22 |
| 2 | B | 0.1 | 1221 | 879 | 838 | 22 |
| 3 | C | 0.3 | 1220 | 925 | 833 | 49 |
| 4 | D | 0.1 | 1202 | 896 | 860 | 29 |
| 5 | E | 0.2 | 1253 | 886 | 879 | 35 |
| 6 | F | 0.3 | 1225 | 898 | 837 | 38 |
| 7 | G | 0.2 | 1228 | 932 | 826 | 32 |
| 8 | H | 0.2 | 1271 | 902 | 913 | 39 |
| 9 | I | 0.2 | 1212 | 933 | 915 | 78 |
| 10 | J | 0.3 | 1245 | 922 | 911 | 55 |
| 11 | K | 0.2 | 1251 | 930 | 820 | 34 |
| 12 | L | 0.5 | 1275 | 937 | 853 | 22 |
| 13 | M | 0.1 | 1210 | 883 | 898 | 51 |
| 14 | N | 0.2 | 1279 | 937 | 887 | 39 |
| 15 | O | 0.3 | 1205 | 879 | 846 | 23 |
| 16 | P | 0.4 | 1255 | 893 | 883 | 26 |
| 17 | Q | 0.2 | 1245 | 896 | 824 | 51 |
| 18 | R | 0.2 | 1213 | 935 | 925 | 38 |
| 19 | S | 0.3 | 1233 | 935 | 846 | 69 |
| 20 | T | 0.2 | 1221 | 913 | 893 | 37 |
| 21 | U | 0.2 | 1271 | 903 | 838 | 39 |
| 22 | V | 0.2 | 1244 | 891 | 831 | 45 |
| 23 | A | 0.9 | 1254 | 924 | 846 | 51 |
| 24 | D | 0.1 | 1171 | 896 | 853 | 59 |
| 25 | G | 0.2 | 1228 | 1020 | 898 | 47 |
| 26 | K | 0.2 | 1251 | 930 | 962 | 53 |
| 27 | N | 0.2 | 1279 | 937 | 908 | 11 |

The resulting wire rods were examined on solute titanium, solute boron, solute nitrogen, [Ti with N], [Ti with C], and [Ti with S] as determined by the following method (electrolytic extraction).

(i) A sample is immersed in an electrolyte (a solution containing 10 percent by volume of acetylacetone and 1 percent by mass of tetramethylammonium chloride in methanol), to which a current is applied at a rate of 20 mA or less per square centimeter of surface area of the sample to electrolyze matrix iron metal in a mass of about 0.4 to about 0.5 g. Precipitates (e.g., TiN, TiC, $Ti_4C_2S_2$, trace contents of TiS, AlN, and BN; hereinafter collectively referred to as a "residue") in the steel, which have been dispersed or precipitated in the electrolyte, are collected from the electrolyte. The residue is collected using a filter having a mesh diameter of 0.1 μm [e.g., Membrane Filter supplied by Advantech Toyo Kaisha, Ltd.].

(ii-a) A nitrogen content (content of compound-type nitrogen: N*) in the residue is determined according to the indophenol blue spectrophotometric method (JIS G 1228, Appendix 3).

(ii-b) A sulfur content (content of compound-type sulfur: S*) in the residue is determined according to the methylene blue spectrophotometric method after separation of hydrosulfide (JIS G 1251, Appendix 7).

(ii-c) A Mn content (content of compound-type manganese: Mn*) and a Ti content (content of compound-type titanium: Ti*) in the residue are determined by placing the residue in a platinum crucible, ashing the filter using a gas burner, adding an alkaline flux thereto, and heating to fuse or melt the residue, adding an acid to the melt to dissolve the melt, transferring the whole quantity of the resulting article into a flask, adding water up to a specific volume, and performing determination with an inductively-coupled plasma (ICP) emission spectrometer.

(ii-d) A boron content (content of compound-type boron: B*) in the residue is determined according to the curcumin spectrophotometric method (JIS G 1227, Appendix 2).

(ii-e) A content of aluminum nitride (AlN*) is determined according to the bromo-ester method.

(iii) A titanium nitride content in the residue is determined based on the nitrogen content (N*), boron content (B*), and aluminum nitride content (AlN*), assuming that nitrogen in the residue is present as TiN, BN, and AlN and that entire boron in the residue is present as BN; from which result a content of titanium present in the form of TiN in the residue [Ti with N] is calculated.

(iv) A content of sulfur present as MnS in the residue ($S^*_{(MnS)}$) is calculated from the Mn content (Mn*) assuming that manganese in the residue is present as MnS. A content of $Ti_4C_2S_2$ in the residue is determined by subtracting the content of sulfur present as MnS($S^*_{(MnS)}$) from the sulfur content (S*) in the residue, assuming that the entire rest of sulfur ($S^*—S^*_{(MnS)}$) is present in the form of $Ti_4C_2S_2$; from which result [Ti with S] is calculated. This calculation method is performed assuming (approximating) that no TiS is formed and that entire sulfides are present as $Ti_4C_2S_2$. In fact, the content of TiS is very small, and [Ti with S] calculated based on the assumption (approximation) does not so differ from the actual value (true value). In addition, a content of titanium present as $Ti_4C_2S_2$ in the residue ($Ti^*_{(Ti4C2S2)}$) is determined from the content of effective residual sulfur ($S^*—S^*_{(MnS)}$) in the residue.

(v) A content of titanium carbide TiC in the residue is determined by subtracting the contents of titanium present as TiN and $Ti_4C_2S_2$ from the titanium content in the residue (Ti*), assuming that the entire rest of titanium ($Ti^*—Ti^*_{(TiN)}—Ti^*_{(Ti4C2S2)}$) is present as TiC; from which result [Ti with C] is calculated.

[Measuring Methods of Solute Titanium, Solute Boron, and Solute Nitrogen]

Solute titanium: Calculated from the total titanium content and the Ti content (Ti*) determined in (ii-c).

Solute nitrogen: Calculated from the total nitrogen content and the nitrogen content (N*) determined in (ii-a).

Solute boron: Calculated from the total boron content and the boron content (B*) determined in (ii-d).

The determined solute titanium, solute boron, solute nitrogen, [Ti with N], [Ti with C], and [Ti with 5] of the wire rods are indicated in Table 3 below.

TABLE 3

| Test number | Steel | Solute boron (mass percent) | Solute nitrogen (mass percent) | Solute titanium (mass percent) | [Ti with N] (mass percent) | [Ti with S] (mass percent) | [Ti with C] (mass percent) |
|---|---|---|---|---|---|---|---|
| 1 | A | 0.0007 | 0.0002 | 0.007 | 0.002 | 0.007 | 0.022 |
| 2 | B | 0.0021 | 0.0003 | 0.006 | 0.004 | 0.018 | 0.035 |
| 3 | C | 0.0021 | 0.000 | 0.003 | 0.005 | 0.019 | 0.079 |
| 4 | D | 0.0012 | 0.000 | 0.009 | 0.004 | 0.015 | 0.039 |
| 5 | E | 0.0018 | 0.0007 | 0.005 | 0.006 | 0.007 | 0.051 |
| 6 | F | 0.0015 | 0.0003 | 0.006 | 0.004 | 0.003 | 0.065 |
| 7 | G | 0.0017 | 0.000 | 0.004 | 0.004 | 0.019 | 0.051 |
| 8 | H | 0.0019 | 0.0002 | 0.003 | 0.005 | 0.006 | 0.033 |
| 9 | I | 0.0006 | 0.000 | 0.005 | 0.005 | 0.009 | 0.030 |
| 10 | J | 0.0022 | 0.0002 | 0.005 | 0.005 | 0.012 | 0.054 |
| 11 | K | 0.0027 | 0.0001 | 0.004 | 0.007 | 0.009 | 0.026 |
| 12 | L | 0.0023 | 0.0001 | 0.004 | 0.004 | 0.010 | 0.061 |
| 13 | M | 0.0017 | 0.0002 | 0.006 | 0.003 | 0.019 | 0.046 |
| 14 | N | 0.0014 | 0.0004 | 0.006 | 0.005 | 0.013 | 0.042 |
| 15 | O | 0.0022 | 0.0004 | 0.006 | 0.004 | 0.010 | 0.035 |
| 16 | P | 0.0014 | 0.000 | 0.005 | 0.003 | 0.006 | 0.057 |
| 17 | Q | 0.0005 | 0.0002 | 0.005 | 0.006 | 0.007 | 0.046 |
| 18 | R | 0.0017 | 0.000 | 0.006 | 0.005 | 0.006 | 0.066 |
| 19 | S | 0.0016 | 0.0003 | 0.005 | 0.006 | 0.009 | 0.042 |
| 20 | T | 0.0011 | 0.0002 | 0.004 | 0.006 | 0.015 | 0.047 |
| 21 | U | 0.0000 | 0.0016 | 0.001 | 0.012 | 0.009 | 0.026 |
| 22 | V | 0.0002 | 0.0011 | 0.000 | 0.002 | 0.003 | 0.009 |
| 23 | A | 0.0018 | 0.0012 | 0.007 | 0.002 | 0.007 | 0.024 |
| 24 | D | 0.0017 | 0.0011 | 0.009 | 0.001 | 0.015 | 0.042 |
| 25 | G | 0.0016 | 0.0005 | 0.037 | 0.006 | 0.019 | 0.016 |
| 26 | K | 0.0022 | 0.0002 | 0.011 | 0.005 | 0.009 | 0.017 |
| 27 | N | 0.0014 | 0.0004 | 0.000 | 0.005 | 0.013 | 0.047 |

The wire rods were then subjected to lead patenting, acid wash, and bonderizing and drawn to a diameter of 0.95 mm using a dry high-speed wire drawing machine (at a die approach angle of 12 degrees) in pass schedules given in Table 4 [Table 4(a) and Table 4(b)] below, from which drawn wires of different diameters were sampled. Conditions for lead patenting are indicated in Table 5 below.

TABLE 4(a)

| Die number | 0 | 1 | 2 | 3 | 4 | 5 | 6 | 7 | 8 | 9 |
|---|---|---|---|---|---|---|---|---|---|---|
| Wire diameter (mm) | 6.00 | 4.90 | 4.31 | 3.81 | 3.38 | 3.01 | 2.70 | 2.43 | 2.19 | 1.98 |
| Reduction of area (%) | — | 33.3 | 22.6 | 21.9 | 21.3 | 20.7 | 19.5 | 19.0 | 18.8 | 18.3 |
| True strain | 0 | 0.23 | 0.49 | 0.73 | 0.97 | 1.20 | 1.42 | 1.63 | 1.84 | 2.04 |

TABLE 4(b)

| Die number | 9 | 10 | 11 | 12 | 13 | 14 | 15 | 16 | 17 | 18 |
|---|---|---|---|---|---|---|---|---|---|---|
| Wire diameter (mm) | 1.98 | 1.80 | 1.64 | 1.50 | 1.38 | 1.27 | 1.17 | 1.08 | 1.00 | 0.95 |
| Reduction of area (%) | — | 17.4 | 17.0 | 16.3 | 15.4 | 15.3 | 15.1 | 14.8 | 14.3 | 9.8 |
| True strain | 2.04 | 2.23 | 2.42 | 2.60 | 2.77 | 2.93 | 3.12 | 3.26 | 3.41 | 3.52 |

TABLE 5

| | | Patenting conditions | | | |
|---|---|---|---|---|---|
| Test number | Steel | Heating temperature (° C.) | Heating time (sec) | Lead heating temperature (° C.) | Immersion time in lead (sec) |
| 1 | A | 920 | 175 | 500 | 63 |
| 2 | B | 960 | 183 | 500 | 65 |

TABLE 5-continued

| | | Patenting conditions | | | |
|---|---|---|---|---|---|
| Test number | Steel | Heating temperature (° C.) | Heating time (sec) | Lead heating temperature (° C.) | Immersion time in lead (sec) |
| 3 | C | 940 | 183 | 520 | 65 |
| 4 | D | 890 | 202 | 490 | 72 |

TABLE 5-continued

| Test number | Steel | Patenting conditions: Heating temperature (° C.) | Heating time (sec) | Lead heating temperature (° C.) | Immersion time in lead (sec) |
|---|---|---|---|---|---|
| 5 | E | 910 | 212 | 510 | 76 |
| 6 | F | 910 | 192 | 520 | 69 |
| 7 | G | 930 | 237 | 520 | 85 |
| 8 | H | 950 | 202 | 500 | 72 |
| 9 | I | 920 | 224 | 530 | 80 |
| 10 | J | 960 | 269 | 530 | 96 |
| 11 | K | 950 | 224 | 550 | 80 |
| 12 | L | 930 | 202 | 520 | 72 |
| 13 | M | 950 | 224 | 520 | 80 |
| 14 | N | 950 | 224 | 500 | 80 |
| 15 | O | 950 | 224 | 530 | 80 |
| 16 | P | 960 | 288 | 530 | 103 |
| 17 | Q | 920 | 192 | 510 | 69 |
| 18 | R | 950 | 224 | 510 | 80 |
| 19 | S | 950 | 224 | 560 | 80 |
| 20 | T | 940 | 224 | 530 | 80 |
| 21 | U | 920 | 175 | 500 | 63 |
| 22 | V | 950 | 202 | 530 | 72 |
| 23 | A | 920 | 202 | 510 | 72 |
| 24 | D | 920 | 175 | 510 | 63 |
| 25 | G | 940 | 192 | 520 | 69 |
| 26 | K | 930 | 202 | 530 | 72 |
| 27 | N | 930 | 202 | 530 | 72 |

The above-prepared drawn wires were examined on drawability by the following method.

[Determination of Drawability]

Drawability was determined by subjecting all the experimentally-manufactured and sampled wires of different diameters to torsion tests. The torsion tests were performed using a torsion tester supplied by Maekawa Testing Machine Mfg. Co., LTD. at a GL (gage length; chuck-to-chuck distance) of 200 mm. A drawing strain of a specimen having the smallest wire diameter among specimens bearing no longitudinal crack in a fracture surface after rupture was defined as a drawable critical strain (a maximum strain at which the wire can be drawn). Independently, a wire strength at the drawable critical strain was measured with a tensile tester (Autograph supplied by Shimadzu Corporation) at a GL (chuck-to-chuck distance) of 200 mm and a strain rate of 10 mm/min.

The results (drawable critical strain and wire strength at the critical strain) together with steels used are indicated as Test Nos. 1 to 27 in Table 6 below.

TABLE 6

| Test number | Steel | Drawable critical strain | Wire strength at critical strain (MPa) |
|---|---|---|---|
| 1 | A | 3.26 | 2530 |
| 2 | B | 3.41 | 2591 |
| 3 | C | 3.26 | 2598 |
| 4 | D | 3.41 | 2461 |
| 5 | E | 3.10 | 2720 |
| 6 | F | 3.26 | 2716 |
| 7 | G | 3.10 | 2811 |
| 8 | H | 3.26 | 2885 |
| 9 | I | 3.26 | 2750 |
| 10 | J | 2.77 | 3165 |
| 11 | K | 2.77 | 3111 |
| 12 | L | 2.93 | 3089 |
| 13 | M | 2.93 | 3293 |
| 14 | N | 2.77 | 3055 |
| 15 | O | 2.77 | 3362 |
| 16 | P | 2.60 | 3265 |
| 17 | Q | 2.60 | 3260 |
| 18 | R | 2.77 | 3411 |
| 19 | S | 2.60 | 3532 |
| 20 | T | 2.60 | 3583 |
| 21 | U | 2.04 | 2135 |
| 22 | V | 1.42 | 2289 |
| 23 | A | 2.42 | 2112 |
| 24 | D | 2.42 | 2095 |
| 25 | G | 2.23 | 2140 |
| 26 | K | 2.04 | 2234 |
| 27 | N | 2.04 | 2390 |

These results indicate as follows (where the following numbers represent the test numbers in Table 6). Nos. 1 to 20 were samples which satisfied the conditions specified in the present invention, satisfied the chemical composition and the conditions specified by Expressions (1) and (2), and gave steel wire rods having high strengths and satisfactory drawability.

In contrast, Nos. 21 to 27 were samples not satisfying any of the conditions specified in the present invention and were poor in at least one of the determined properties. Among them, No. 21 had a large nitrogen content and a large content of solute nitrogen and failed to provide satisfactory drawability.

No. 22 was a sample which had a Ti content and a content of solute titanium each lower than the specified range, included precipitates such as TiC in small amounts, included solute nitrogen in a large content, and failed to provide satisfactory drawability.

No. 23 underwent casting at a high solidifying rate (Table 2), suffered from insufficient formation of TiN with a large amount of remaining solute nitrogen, and had poor drawability. No. 24 underwent heating at a low temperature prior to hot rolling (Table 2), included solute nitrogen in a large content, and failed to provide satisfactory drawability.

No. 25 underwent hot rolling starting from a high temperature (Table 2), suffered from insufficient contents of precipitates such as TiC, and failed to provide satisfactory drawability. No. 26 underwent cooling starting from a high temperature (Table 2), suffered from insufficient contents of precipitates such as TiC, and failed to provide satisfactory drawability. No. 27 underwent cooling at a low cooling rate from the cooling start temperature down to 700° C., failed to include solute titanium in a necessary amount, and had poor fatigue strength (torsional fatigue strength) and poor drawability.

Figure 2:
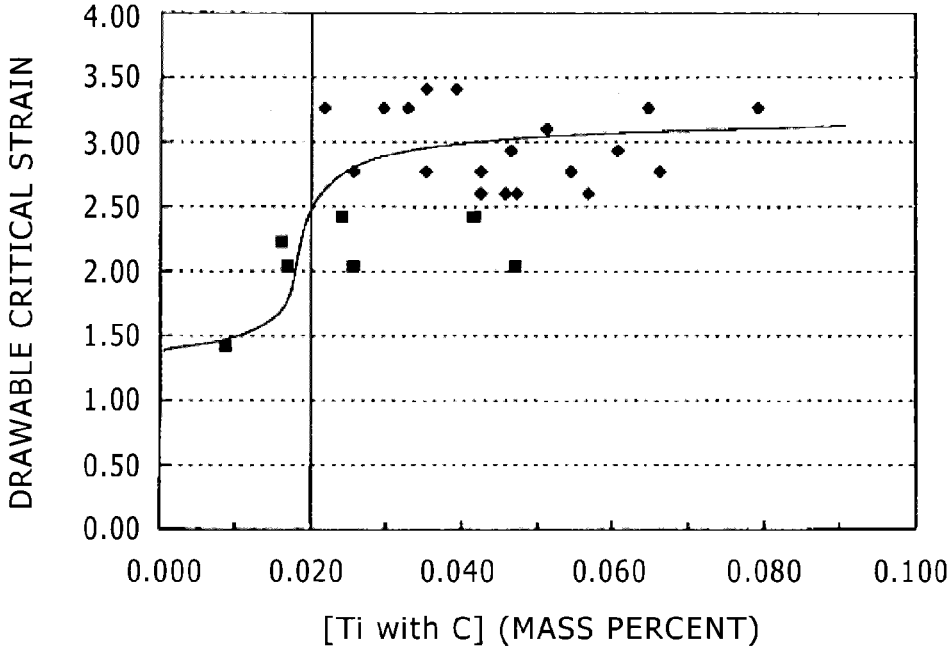
FIG. 2 is a graph illustrating how the drawable critical strain varies depending on the content of Ti in the form of a carbide [Ti with C].

Based on these results, FIG. 1 illustrates how the drawable critical strain varies depending on the content of solute titanium [sol.Ti]; and FIG. 2 illustrates how the drawable critical strain varies depending on the content of titanium in the form of a carbide such as TiC [Ti with C]. In FIGS. 1 and 2, data indicated by the filled diamond "◆" are data of samples satisfying the conditions specified in the present invention (Examples); and data indicated by the filled square "■" are data of samples not satisfying at least one of the conditions specified in the present invention (Comparative Examples).

The invention claimed is:

1. A high carbon steel wire rod comprising, in mass %:

C in a content of 0.6% to 1.5%;

Si in a content of 0.1% to 1.5%;

Mn in a content of 0.1% to 1.5%;

P in a content of more than 0% and less than or equal to 0.02%;

S in a content of more than 0% and less than or equal to 0.02%;

Ti in a content of 0.03% to 0.12%;

B in a content of 0.001% to 0.01%;

N in a content of 0.001% to 0.005%, and iron and inevitable impurities, wherein:

a solute boron content is 0.0002% or more;

a solute nitrogen content is 0.0010% or less;

the high carbon steel wire rod satisfies formulas (1) and (2):

$$[\text{sol.Ti}]=[\text{Ti}]-[\text{Ti with N}]-[\text{Ti with C}]-[\text{Ti with S}]\geq 0.002\ (\text{mass }\%) \quad (1),$$

$$[\text{Ti with C}]\geq 0.020\ (\text{mass }\%) \quad (2),$$

where:

[sol.Ti] represents a content of solute titanium dissolved in the high carbon steel wire rod;

[Ti] represents a total Ti content in the high carbon steel wire rod;

[Ti with N] represents a content of Ti in the form of a nitride in the high carbon steel wire rod;

[Ti with C] represents a content of Ti in the form of a carbide in the high carbon steel wire rod; and

[Ti with S] represents a content of Ti in the form of a sulfide in the high carbon steel wire rod.

2. The high carbon steel wire rod of claim 1, further comprising Al in a content of more than 0% and less than or equal to 0.1% by mass.

3. The high carbon steel wire rod of claim 1, further comprising at least one selected from the group consisting of: Cr in a content of more than 0% and less than or equal to 0.45% by mass; and V in a content of more than 0% and less than or equal to 0.5% by mass.

4. The high carbon steel wire rod of claim 1, wherein the content of B in the high carbon steel wire rod is 0.0020% or more by mass.

5. The high carbon steel wire rod of claim 1, wherein the content of solute titanium dissolved in the high carbon steel wire rod is 0.003% or more by mass.

6. The high carbon steel wire rod of claim 1, wherein the content of solute titanium dissolved in the high carbon steel wire rod is 0.004% or more by mass.

7. The high carbon steel wire rod of claim 1, wherein the content of Ti in the form of a carbide in the high carbon steel wire rod is 0.021% or more by mass.

8. The high carbon steel wire rod of claim 1, wherein the content of Ti in the form of a carbide in the high carbon steel wire rod is 0.022% or more by mass.

9. The high carbon steel wire rod of claim 1, wherein the content of C in the high carbon steel wire rod is 0.65% or more by mass.

10. The high carbon steel wire rod of claim 1, wherein the content of C in the high carbon steel wire rod is 1.4% or less by mass.

11. The high carbon steel wire rod of claim 1, wherein the content of Si in the high carbon steel wire rod is 0.15% or more by mass.

12. The high carbon steel wire rod of claim 1, wherein the content of Si in the high carbon steel wire rod is 1.4% or less by mass.

13. The high carbon steel wire rod of claim 1, wherein the content of Mn in the high carbon steel wire rod is 0.2% or more by mass.

14. The high carbon steel wire rod of claim 1, wherein the content of Mn in the high carbon steel wire rod is 1.4% or less by mass.

15. The high carbon steel wire rod of claim 1, wherein the content of P in the high carbon steel wire rod is 0.01% or less by mass.

16. The high carbon steel wire rod of claim 1, wherein the content of S in the high carbon steel wire rod is 0.01% or less by mass.

17. The high carbon steel wire rod of claim 1, wherein the content of Ti in the high carbon steel wire rod is 0.04% or more by mass.

18. The high carbon steel wire rod of claim 1, wherein the content of Ti in the high carbon steel wire rod is 0.11% or less by mass.

19. The high carbon steel wire rod of claim 1, wherein the content of B in the high carbon steel wire rod is 0.009% or less by mass.

* * * * *